US005679220A

United States Patent [19]

Matthew et al.

[11] Patent Number: 5,679,220

[45] Date of Patent: Oct. 21, 1997

[54] PROCESS FOR ENHANCED DEPOSITION AND RETENTION OF PARTICULATE FILLER ON PAPERMAKING FIBERS

[75] Inventors: M. C. Matthew, Morris Plains; Sanjay Patnaik, Westwood, both of N.J.; Paul Hart, Surfside Beach, S.C.; Thomas Amidon, Highland Mills, N.Y.

[73] Assignee: International Paper Company, Purchase, N.Y.

[21] Appl. No.: 375,485

[22] Filed: Jan. 19, 1995

[51] Int. Cl.[6] ..... D21H 17/64

[52] U.S. Cl. ..... 162/181.4; 162/9; 162/183; 162/158; 162/181.1

[58] Field of Search ..... 162/158, 181.1, 162/181.2, 181.4, 182, 183, 185, 9

[56] References Cited

U.S. PATENT DOCUMENTS

| | | | |
|---|---|---|---|
| 4,018,877 | 4/1977 | Woode | 423/432 |
| 4,157,379 | 6/1979 | Arika et al. | 423/430 |
| 4,889,594 | 12/1989 | Gavelin | 162/130 |
| 5,096,539 | 3/1992 | Allan | 162/9 |
| 5,122,230 | 6/1992 | Nakajima | 162/157.1 |
| 5,158,646 | 10/1992 | Nakajima | 162/9 |
| 5,219,660 | 6/1993 | Wason et al. | 428/403 |
| 5,223,090 | 6/1993 | Klungness et al. | 162/9 |
| 5,244,542 | 9/1993 | Bown et al. | 162/164.3 |
| 5,275,699 | 1/1994 | Allan et al. | 162/181.2 |

FOREIGN PATENT DOCUMENTS

| | | | |
|---|---|---|---|
| 2093545 | 10/1993 | Canada | 162/181.1 |
| 62-162098 | 7/1987 | Japan | D21H 3/78 |
| 62-199898 | 9/1987 | Japan | D21H 03/78 |

OTHER PUBLICATIONS

STIC translation of Japan Kokai No. 62–162098 by Yoshida et al.

Octave Levenspiel, "Chemical Reaction Engineering", second edition, John Wiley & Sons.

Japanese Patent Laid–Open No. 162098 Application No. 297382, Jul. 17, 1987.

Japanese Patent Laid–Open No. 199898 Application No. 37592, Sep. 3, 1987.

*Primary Examiner*—Donald E. Czaja
*Assistant Examiner*—Jose A. Fortuna
*Attorney, Agent, or Firm*—Paul E. Hodges, P.C.

[57] ABSTRACT

A method for enhancing the deposition and retention of particulate filler on papermaking fibers. In a first vessel, there is formed a slurry of papermaking fibers and in a second vessel there is formed a slurry of lime or its equivalent. The fiber slurry is at a consistency of not greater than about 5%. These separately formed slurries are thereafter combined with a gaseous precipitant in a flow reactor and under conditions whereby the gaseous precipitant is subjected to rapid shear and calcium carbonate is deposited in situ on the fibers. Unexpectedly, the reaction time for the formation and deposition of the calcium carbonate filler is very rapid. Control over the pH of the reactants in the reactor is achieved through the sequence of introduction of the reactants to the reactor. Also, through selection of the molar ratio of the gaseous precipitant and lime, the morphology of the calcium carbonate crystals may be controlled.

10 Claims, 4 Drawing Sheets

PROCESS FOR ENHANCED DEPOSITION AND RETENTION OF PARTICULATE FILLER ON PAPERMAKING FIBERS

FIELD OF INVENTION

This invention relates to the deposition and retention of filler on papermaking fibers, and specifically to the deposition and retention of calcium carbonate or equivalent particulate filler on fibers suitable for papermaking.

BACKGROUND OF INVENTION:

Calcium carbonate has long been used as a filler for papermaking fibers. The use of fillers and their advantages in papermaking are well known in the art. Among other things, fillers enhance the optical properties of the paper or paper product formed from the filled papermaking furnish, and reduce the cost of the paper or paper product. Numerous efforts have been made to increase the percentage of filler in a papermaking furnish, but in general, not greater than 20% by weight of filler in a papermaking furnish has been found to be feasible. Fillers, however, especially particulate fillers, present problems in the papermaking process and equipment due to accumulation of the filler in the white water from the paper forming (wet end) of a papermaking machine, due to scaling on various components of the papermaking equipment and ancillary equipment such as pumps, piping, storage tanks, etc. These problems are exacerbated when the filler content of the prior art filled papermaking furnishes contain greater than about 20% of filler by weight. In the art, retention aids such as alum, starch, polymers, etc. have been added to the furnish to reduce the loss of filler in the course of formation of the paper web. These additives increase the cost the paper product and adversely affect the drainage on the forming fabric and the formation of the paper web.

The chemical reaction of slaked lime with carbon dioxide gas to form a slurry of calcium carbonate particulates is well known in the art. By way of example, U.S. Pat. No. 4,018,877 discloses the formation of calcium carbonate by mixing calcium hydroxide (milk of lime) and carbon dioxide gas, with vigorous mixing, to produce a calcium carbonate precipitate. In this patent, as in other prior art patents, the carbonation is carried out in multiple steps. In this patent, it is taught to add a long chain fatty acid salt to the slurry after the second carbonation and before filtering to reduce aggregation of small particles of calcium carbonate. U.S. Pat. No. 4,157,379 discloses the addition of a chelating agent and a water soluble metal salt during the carbonation to improve the length to diameter ratio of the "chain structured" calcium carbonate.

Japanese Laid Open Patent Application No. 162098/1987 discloses a process for precipitating calcium carbonate filler in a slurry of fibers. In this process, slaked lime or the equivalent is added to a slurry of papermaking fibers and thereafter the slurry is contacted with carbon dioxide gas to precipitate the calcium carbonate "in the slurry". This precipitate is said to attach itself to the fibers, especially to the fibrils of a fibrillated fiber. This patent speaks to the speed of the reactions, for example, 10 minutes for mixing in the lime and 30 minutes for the carbon dioxide treatment.

Japanese Laid Open Patent Application No. 199898/1987 discloses formation of calcium carbonate filler in a slurry of papermaking fibers by the stepwise addition of an alkali carbonate and lime to the slurry to cause calcium carbonate to precipitate onto the fibers. The order of adding the alkali carbonate and the lime is said to not be critical. The filled fibers are used to make a neutral paper.

In U.S. Pat. No. 5,122,230 it is claimed that a modified pulp having 32% calcium carbonate on the pulp (based on the dry weight of the pulp) is obtainable in a multi-step process. In the first step, the fibers are immersed in an aqueous solution comprising 6 to 60% by weight of a water-soluble inorganic compound (an alkaline earth metal hydroxide, for example) which is converted to a substantially water-insoluble inorganic compound (an alkaline earth metal carbonate, for example) when brought into contact with a precipitant (carbon dioxide). In a second step, the amount of the water-soluble inorganic compound impregnated in the fibers is adjusted to a level of 60 to 400% based on the dry weight of the fibers, and in a third step, the impregnated fibers are brought into contact with the gaseous precipitant to precipitate and fix the water-insoluble inorganic compound (calcium carbonate) to the fibers.

In U.S. Pat. No. 5,233,090 there is claimed a method for loading the "hollow interior" and the "fiber walls" of papermaking fibers with calcium carbonate. This method includes the steps of adding either calcium oxide or calcium hydroxide to cellulosic fibers having a moisture content "at a level sufficient to provide said cellulosic fibrous material in the form of dewatered crumb pulp", and contacting the fibrous material with carbon dioxide while subjecting the fibrous material to "higher" shear mixing to cause a substantial amount of the calcium carbonate to be loaded within the hollow interior and within the cell walls of the fibers. The fibers of this process are required to contain less moisture than the free moisture level, preferably from about 40% to about 95% moisture, by weight.

Enhancement of the retention of a filler on fibers by imparting a positive electrical charge to the filler particles is disclosed in U.S. Pat. No. 5,244,542. In this patent, the process is said to comprise surface-treating calcium-containing particles with a dispersing agent comprising an anionic polyelectrolyte and a cationic polyelectrolyte to render the particles cationic.

U.S. Pat. No. 5,096,539 discloses a process for in situ formation of a filler in the pores or on the cell walls of "never dried" cellulosic fibers. In the process the fibers are dispersed in a first solution (containing calcium chloride, for example), filtered and reimmersed in a second solution (sodium carbonate, for example) whereby the salts react to precipitate the filler (calcium carbonate) in the pores or, in the cell walls of the fibers.

The noted foregoing efforts directed toward enhancing the deposition and retention of a filler, especially calcium carbonate, on papermaking fibers, each have limitations which make them less than commercially acceptable. For example, the multi-step processes increase the cost associated with the use of a filler. The formation of the filler in situ on fibers in a slurry requires specially prepared fibers or fibers having a unique property. Others of the prior processes require the use of expensive additives, require inordinate time for carrying out the process, etc. Further, the retention of the filler on the fibers is less than desirable, especially with higher filler loading values. Many of the prior art processes require the use of filler retention aids to avoid the many deleterious effects of the filler in the papermaking system.

Importantly, none of the known prior art processes for in situ producing calcium carbonate-filled papermaking fibers adequately addresses the problem of discoloration of the papermaking fibers. For example, prior art processes for the in situ deposition of calcium carbonate onto groundwood fibers results in unacceptable "yellowing" of the fibers by reason of the relatively higher pH values which are commonly employed in these processes.

The present inventors have discovered that the deposition and retention of a particulate filler on papermaking fibers can be enhanced through the means of a process in which a slurry of papermaking fibers having a consistency of not greater than about 5% is formed in a first vessel, a slurry of particulate calcium hydroxide is formed in a second vessel, and thereafter the slurries, as a flowing stream in a reactor, are reacted with a gaseous precipitant, such as gaseous carbon dioxide. This process has been found to provide unexpectedly fast formation and deposition of calcium carbonate on the fibers. Further it has been found that the quantity of filler which can be deposited on the fibers and, importantly, retained on the fibers, is materially increased over that quantity which has been known to be practical in the prior art. Whereas the prior art reports filler loadings on fibers of about 30%, the process employed to obtain these loadings is not economically practical. The process discovered by the present inventors is simple, very cost effective, does not require the use of filler retention aids, and has been found to provide a paper product having good formation and other desirable properties. Further, by means of their process, the present inventors can select the morphology of the calcium carbonate crystals which are deposited on the fibers, and can maintain the pH of the reactant stream at or below that value which adversely affects certain papermaking fibers, such as groundwood fibers.

It is therefore an object of the present invention to provide an improved process for the deposition and retention of particulate filler on papermaking fibers.

Other objects and advantages of the present invention will be recognized from the description contained herein, including the Figures in which:

DETAILED DESCRIPTION OF THE INVENTION

Figure 1:
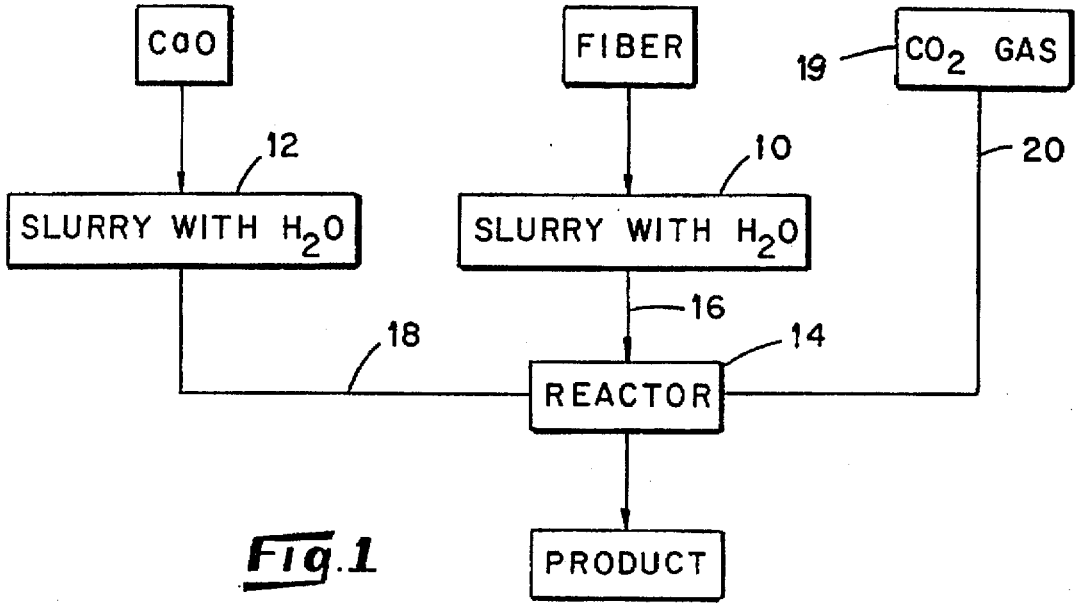
FIG. 1 is a schematic diagram of a process employing various of the features of the present invention.

With reference to FIG. 1, in accordance with the present invention, in a first vessel 10, there is formed a slurry of papermaking fibers. This slurry may include any of the usual papermaking fibers, such as virgin, cellulosic, synthetic, recycled, and secondary fibers, or combinations of these fibers, and preferably comprises cellulosic fibers slurried in water. Further, the cellulosic fibers may be those as found in any of the common papermaking pulps, including groundwood, chemical, and other pulps. The present process is also suitable for depositing particulate calcium carbonate onto secondary fibers as described in copending application entitled: METHOD FOR IMPROVING BRIGHTNESS AND CLEANLINESS OF SECONDARY FIBERS FOR PAPER AND PAPERBOARD MANUFACTURE, Inventors: Narenda R. Srivatsa, Sanjay Patnaik, Paul Hart, Thomas Amidon and Jean J. Renard, filed contemporaneously herewith, and which is incorporated herein in its entirety by reference. The quantity of fibers included in the slurry is limited to that quantity of fibers which develops a consistency of not greater than about 5%, based on the weight of the dried fibers in the slurry. Slurry consistencies in excess of about 5% result in lower efficiencies of gas-liquid reaction, hence longer contact times for completion of the formation of the particulate filler and its deposition on the fibers, and therefore are not desired. There is no requirement that the fibers be highly refined or possess a particular level of freeness prior to their introduction into the slurry. Slurries having a Canadian Standard Freeness of from 50 to 650 have been employed successfully.

In a second, and physically separate, vessel 12, there is formed a slurry of particulate calcium hydroxide or its equivalent. The calcium hydroxide source may be pebbles (spherical pellets), active lime, or hydrated lime (fine powder). Commercial agricultural lime has been used successfully. These particles preferably are slurried in water, using known slurrying techniques.

In the present invention, the inventors have discovered at least three important operational factors associated with the deposition of the calcium carbonate on the fibers. First, it has been found that the process of forming and depositing of the calcium carbonate particulates on the fibers should be carried out in a flowing stream, as opposed to a batch-type mixing process. This discovery has permitted the inventors to achieve reaction times for the deposition of the calcium carbonate particulates on the fibers that are extremely short, thereby making the present process uniquely suited for continuous operation, with concomitant economic benefits. Second, it has been found that the sequence of combination of the calcium hydroxide slurry, the fiber slurry and the gaseous precipitant may be selected to alter the pH of the reacting components, thereby making it possible to employ the present invention to process a very large variety of papermaking fibers. Third, it has been found that adjustment of the carbon dioxide/calcium hydroxide ratio may be employed to alter the morphology of the calcium carbonate crystals produced and deposited on the fibers, thereby allowing one to adjust the brightness and opacity of a paper product produced from papermaking fibers produced by the present method.

With reference to FIG. 1, in one embodiment of a process employing the concepts of the present invention, the slurry of papermaking fibers from the first vessel 10 is combined, in a reactor 14, with the slurry of calcium hydroxide from the second vessel 12. This combining of the slurries may take the form of flowing each of the slurries from their respective reactors through conduits 16 and 18 into the reactor 14. Substantially simultaneously with the introduction of the slurries into the reactor 14, the precipitant, e.g. carbon dioxide gas, from a source 19 thereof, is introduced into the reactor 14 as by means of a conduit 20. The carbon dioxide gas may be pure carbon dioxide gas (100%) or from a source such as flue gas, or other similar source. The reactor 14 may be a conventional reactor, such as a spouted vessel with one or more ports for injecting the gas and the calcium hydroxide slurry into the reactor. An in-line mixer may be employed to enhance the combination of the reactants, but such is not required.

Figure 2:
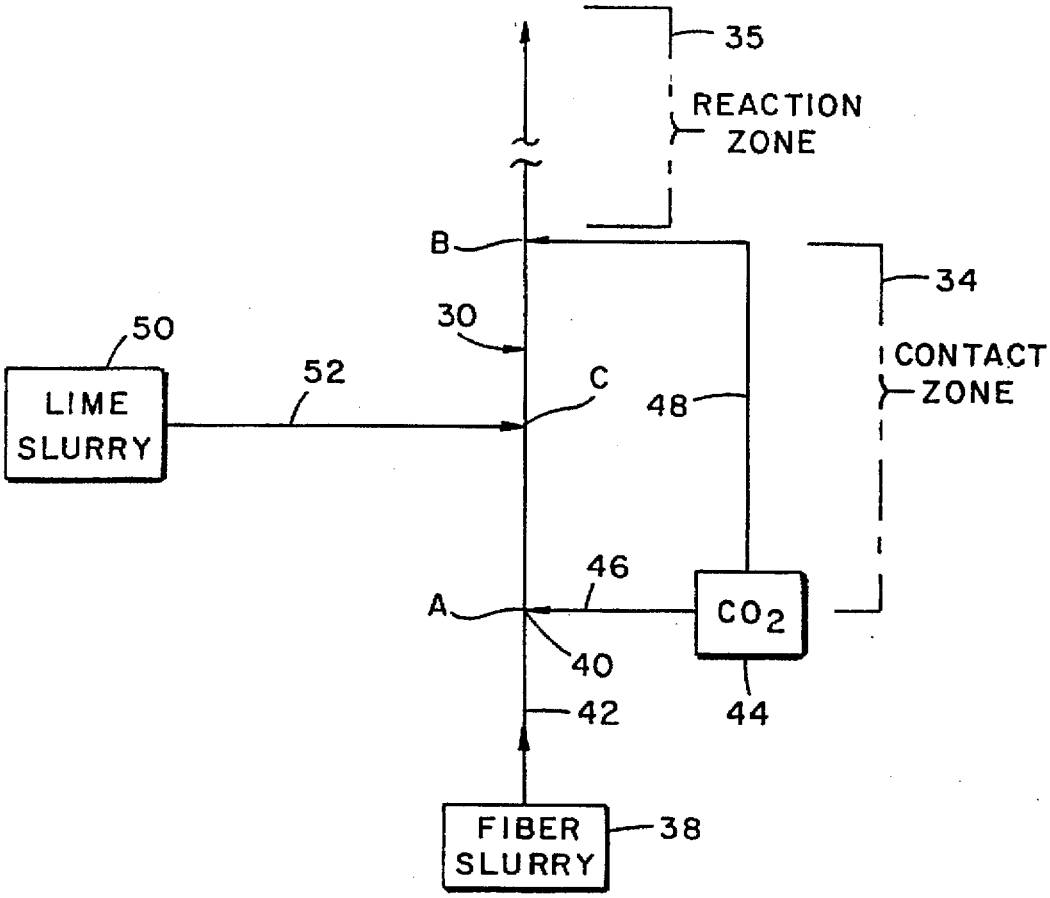
FIG. 2 is a schematic representation of one embodiment of an apparatus for carrying out the process of the present invention.

With reference to FIG. 2, in one embodiment of apparatus for carrying out the process of the present invention, the inventors have employed a reactor, indicated generally by the numeral 30. This reactor includes a contact zone 34 which comprises a smooth internal-walled cylindrical conduit of ¼ inch internal diameter and a reaction zone 35 which includes a smooth internal-walled cylindrical conduit of 3 inches internal diameter. A fiber slurry from a source 38 is introduced into the lower end 40 of the contact zone of the reactor as by means of a conduit 42. At a location downstream of the point of introduction of the fiber slurry and at the beginning of the contact zone 34, carbon dioxide gas from a source 44 thereof is introduced into the reactor 30 at Point "A" through a conduit 46 and mixing of the carbon dioxide with the fiber slurry commences. At a location, Point "B", further downstream in the reactor, additional carbon dioxide gas from the source 44 is introduced into the reactor via a conduit 48. At Point "C" which is located approximately halfway between Points "A" and "B", the slurry of calcium hydroxide from a source 50 thereof is introduced into the reactor via a conduit 52. In the present specific example, Points "A" and "B" are disposed six inches apart along the length of the reactor, and Point "C" is located essentially three inches from either of Points "A" and "B". These dimensions of the reactor provided a volume within the reaction zone of 0.001275 gal. In this specific example, the flow rate of the gaseous carbon dioxide into the reactor was 5.7 scfm (equals total flow through the two ports "A" and "B"). The fiber slurry was introduced into the reactor at a flow rate of 2 gpm which converts into a residence time (hence reaction time) within the contact zone of $6.37\times10^{-4}$ minute. In this specific example, substantially complete conversion of the calcium hydroxide to calcium carbonate can take place within the contact zone. Through the addition of a reaction zone downstream of the contact zone, the residence time of the reactants within the reactor may be increased, if desired, to ensure 100% conversion of the calcium hydroxide to calcium carbonate. As is recognized in the art, carryover of the alkaline calcium hydroxide into the papermaking process severely disrupts the chemistry of the papermaking process and is to be avoided. By way of example, increasing the time of residence of the reactants within the reactor by adding a reaction zone comprising a smooth inner wall cylindrical reaction zone having an internal diameter of 3 inches and ten feet in length, and using the same flow rate of fiber slurry, will provide a maximum reaction time of only 1.84 minutes, which time has been found to be sufficient to ensure complete conversion of the calcium hydroxide. Whether one uses a smaller internal diameter reactor or a larger internal diameter is influenced by factors such as the desired throughput of the system. Calcium carbonate loadings of at least 30% on the fibers are readily obtainable at the 2 gpm flow rate of the fiber slurry and employing a contact zone of 6 inches length and of an internal diameter of the reactor of ¼ inch as described in the above specific example. The fiber used was groundwood pulp and agricultural lime was used as the source of the calcium hydroxide. Pure carbon dioxide gas was employed. Preferably the carbon dioxide is introduced at a constant flow rate.

Figure 3:
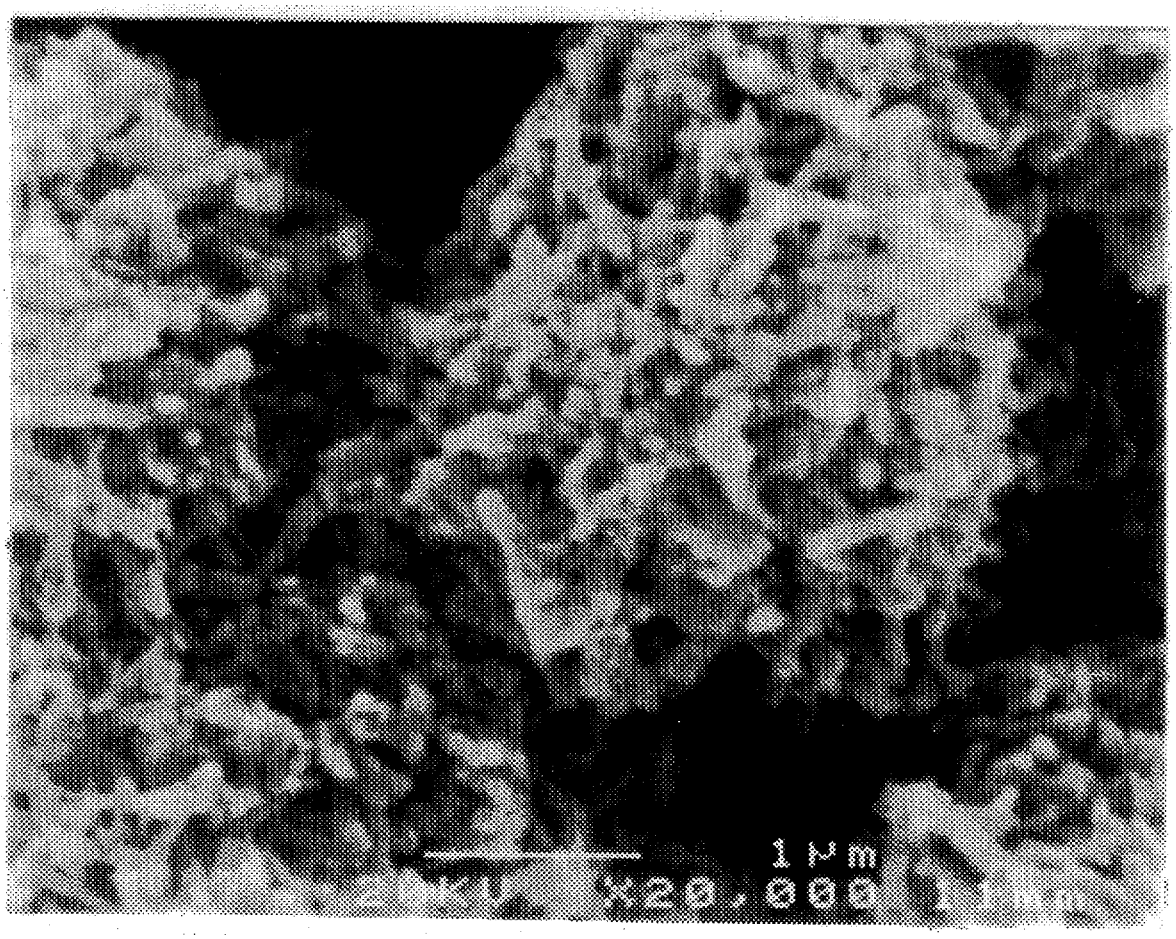
FIGS. 3–5 are photomicrographs of papermaking fibers filled with calcium carbonate at various molar ratios of carbon dioxide and calcium hydroxide employed in their manufacture by the method of the present invention.
Figure 4:
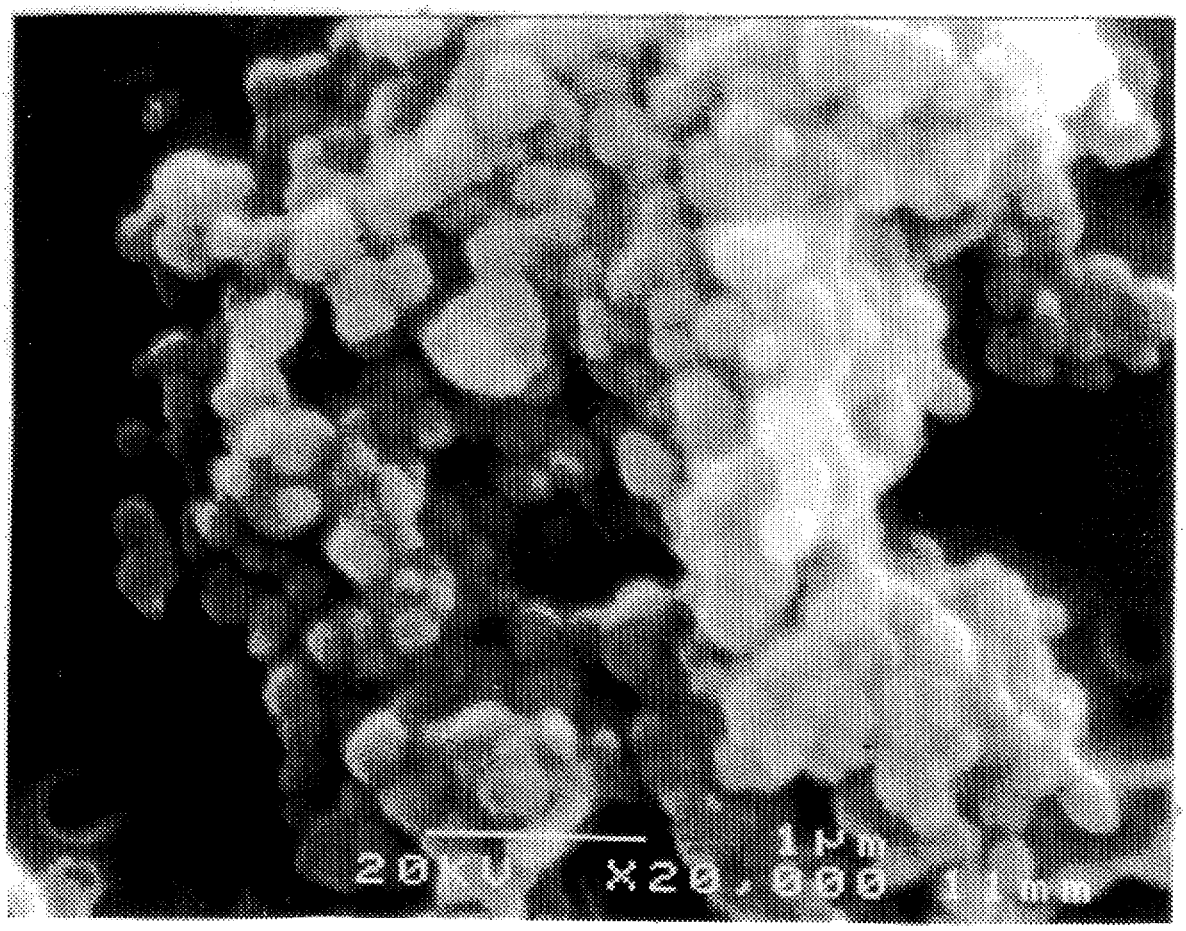
Figure 5:
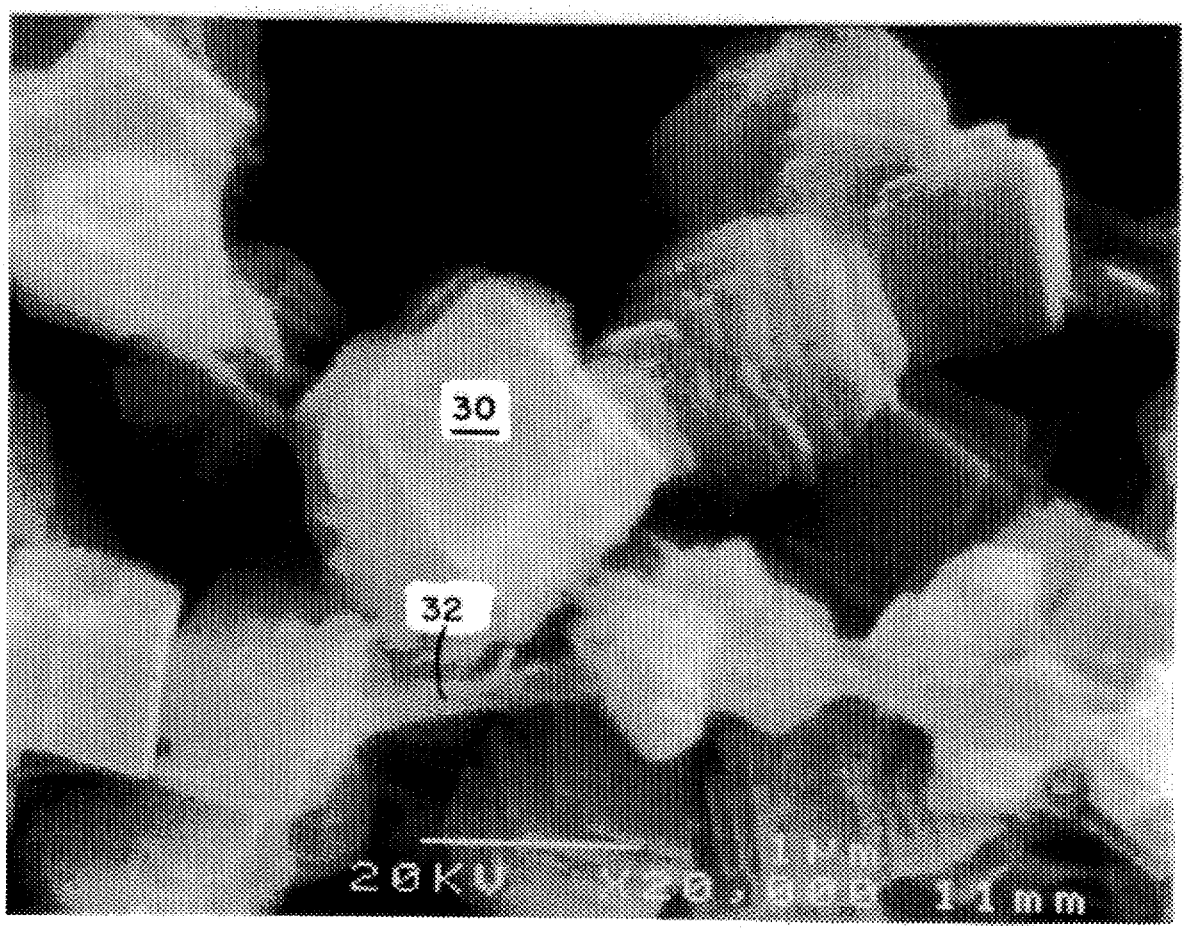

The total quantity of precipitant (carbon dioxide gas) added to the reactor can be below, at or above the stoichiometric demand of the system. Preferably, the carbon dioxide/calcium hydroxide (lime) ratio does not vary between more than 0.1 and 10, and most preferably is about 1.5 for complete one-pass completion of the calcium hydroxide-carbon dioxide reaction. It has been found that the carbon dioxide/calcium hydroxide ratio may be selected to control the size and shape of the resulting calcium carbonate crystals. For example, the lower ratios produce smaller, more spherical calcium carbonate crystals, whereas the calcium carbonate crystals produced using the higher ratios of the stated range tend to be larger and less spherical. FIGS. 3–5 are photomicrographs of calcium carbonate crystals 30 which were deposited on papermaking fibers 32 using the present method. The crystals depicted in each of FIGS. 3–5 were deposited on papermaking fibers using the method of the present invention. All the operational parameters employed were identical, except that the molar ratio of calcium dioxide to calcium hydroxide (lime) was varied between the runs. The crystals depicted in FIG. 3 were deposited using a molar ratio of carbon dioxide to calcium hydroxide of 0.7; the crystals of FIG. 4 were deposited using a molar ratio of 0.9; and, the crystals of FIG. 5 were deposited using a molar ratio of 1.4. It is noted in FIG. 3 that the crystals are generally more rod-like in shape and are relatively closely packed. The crystals of FIG. 4, where the molar ratio of carbon dioxide to calcium hydroxide was 0.9, are more spherical in geometry, and more loosely packed than the crystals of FIG. 3. The crystals depicted in FIG. 5, are more plate-like, and formed at a molar ratio of 1.4.

As noted, it is important in the present method that the slurries and the gaseous precipitant be introduced to one another as a flowing stream. Irrespective of whether the fiber slurry and the calcium hydroxide slurry are introduced to one another prior to their introduction as a single flowing stream into the contact zone of the reactor, or whether these slurries are introduced into the contact zone as separate flowing streams, it is important that at least the fiber slurry be flowing through the contact zone of the reactor prior to the introduction of the gaseous carbon dioxide to the contact zone. This procedure has been found necessary to ensure that the gaseous carbon dioxide is substantially dispersed within the flowing slurry stream as quickly as reasonably possible after, and preferably substantially simultaneously with, its introduction into the contact zone of the reactor. This dispersion may take the form of multitudes of bubbles of the gas, but the form of dispersion is not so critical as is the fact that the gas be amply dispersed, and quickly. This dispersion is effected in the present invention by the shear imparted to the stream of gaseous carbon dioxide as it enters the contact zone and is swept away from its inlet port into the flowing slurry stream. Whereas the degree of this shear may vary depending upon the consistency of the slurry flowing through the contact zone, the flow rate of the slurry, the size and geometry of the contact zone, and other factors, it has been found the adequate shear is provided under the operating conditions described hereinabove in the specific example employing a ¼ inch diameter reactor (in the contact zone), 1.5% consistency of the fiber slurry, a flow rate of the fiber slurry of 2 gpm, and the other operating parameters described.

In accordance with another aspect of the present invention, the sequence of introduction of the fiber slurry, the calcium hydroxide slurry and the gaseous carbon dioxide to the contact zone of the reactor may be varied to achieve a desired pH of the flowing stream within the contact zone and, consequently, the pH of the resulting filled-fiber slurry. For example, premixing the fiber slurry (commonly at a pH of about 6.0 to 8.0) and the calcium hydroxide slurry prior to their introduction into the contact zone results in a pH of the combined slurries in the contact zone of about 11.0 which is too alkaline for the successful processing of certain papermaking fibers, such as lignin-containing fibers like groundwood fibers which discolor under such alkaline conditions. Other alkaline-sensitive papermaking fibers include brownstock and recycled pulp from old newsprint/magazines. This higher pH, however, is acceptable for other papermaking fibers. In any event following the introduction of the gaseous carbon dioxide to the contact zone and its reaction with the calcium hydroxide, the pH of the filled-fiber slurry exiting the reactor is between about 6.0 and 8.0, which is the commonly desired pH for a papermaking pulp. In this example, the gaseous carbon dioxide is introduced to the contact zone downstream of the introduction of the fiber/calcium hydroxide slurries. On the other hand, it has been found that by introducing at least a portion of the total quantity of carbon dioxide required for the conversion of the calcium hydroxide at a location along the length of the contact zone downstream of the introduction point for the fiber slurry, but upstream of the introduction point for the calcium hydroxide slurry, one can develop a pH of the flowing stream within the contact zone of about 9.0, a value which is acceptable for those fibers which are alkaline-sensitive. In this example, preferably, the carbon dioxide is introduced into the contact zone at two (or more) separated inlet ports, and the calcium hydroxide slurry is likewise split into two (or more) incoming streams and introduced into the contact zones at locations which alternate (in a regular or irregular pattern) with respect to the inlet ports for the carbon dioxide. In this manner, the pH of the flowing stream within the contact zone remains at about 9.0 until the final introduction of carbon dioxide which reduces the pH of the flowing stream to the desired pH of about 6.0 to 8.0.

A temperature of between about 35° F. and 180° F. within the reactor has been found acceptable. Preferably the temperature within the reactor is maintained at between 50° F. and 120° F. The pressure within the reactor may vary between atmospheric pressure (14.6 psi) to several atmospheres above ambient. No specific control of the pressure within the reactor is required but pressure controls may be used if desired. Notably, there is no requirement for soaking or the like of the slurries following their combination, and prior to their contact with the gaseous carbon dioxide as is required in many prior art processes.

As will be recognized by one skilled in the art, one may enhance the efficiency of contacting, hence the rate of reaction between the reactants in the reactor 14 as by inline mixers, altering the length of the reaction zone, addition of chemical or crystal morphological modifiers, etc. As desired, chelants may be employed to enhance and protect brightness. The use of these aids, however, is not required in order to obtain the benefits of the present invention.

As noted, it is of importance that the stream of flowing fiber slurry and/or the stream of combined fiber slurry and calcium hydroxide slurry subject the gaseous precipitant to rapid shear substantially at the time of, or essentially immediately after, the addition of the carbon dioxide gas to the flowing slurry or combination of slurries. This shear is believed to shear the gas into small bubbles as it enters the flowing stream of fiber slurry in the reactor, presumably making the carbon dioxide readily available for more immediate reaction with the calcium hydroxide. This action is believed to be a major factor in the short reaction times in the reactor as have been found by the present inventors. Most usually the shear imparted to a gaseous precipitatnt by the flowing stream of a slurry or combination of slurries by reason of its movement, under pressure, along the length of the reactor is sufficient for purposes of the present invention. If required for a particular slurry or combination of slurries, further shear may be developed by means of a pump, inline mixer or other device which introduces further shear into the slurry stream.

In the specific example described hereinabove, designated Example I for identification purposes, for the production of a filled-fiber slurry employing the present invention, the fibers were loaded to 30% calcium carbonate. "Loading" was calculated using the formula:

$$\text{Loading}(\%) = \frac{\text{Dry weight of calcium carbonate}}{\text{Dry weight of calcium carbonate + fibers}} \times 100$$

Table I below presents further examples of the production of filled fibers suitable for papermaking. In each of the following examples, the fiber slurry and the calcium hydroxide slurry were mixed prior to the introduction of the carbon dioxide to the flowing stream.

TABLE I

Example 2

Reactor Data

| | Length (inches) | ID (inches) | Volume gal | Contact Time min |
|---|---|---|---|---|
| Contact Zone | 2.5 | ½ | $2.12 \times 10^{-3}$ | $4.5 \times 10^{-4}$ |
| Reaction Zone | 78 | 6 | 9.5 | 2.0 |

| Slurry Flow | $CO_2$ Flow | Loading | Fiber Source |
|---|---|---|---|
| 4.7 gpm | 3.4 gpm | 75% | Softwood, bleached pulp 280 CSF |

Example 3

Reactor Data

| | Length (inches) | ID (inches) | Volume gal | Contact Time min |
|---|---|---|---|---|
| Contact Zone | 2.5 | ½ | $2.12 \times 10^{-3}$ | $5.4 \times 10^{-4}$ |
| Reaction zone | 78 | 6 | 9.5 | 2.4 |

| Slurry Flow | $CO_2$ Flow | Loading | Fiber Source |
|---|---|---|---|
| 3.9 gpm | 3.02 scfm | 10% | Laser-free computer print out (recycled) |

Example 4

Reactor Data

| | Length (inches) | ID (inches) | Volume gal | Contact Time min |
|---|---|---|---|---|
| Contact Zone | 5 | 2.5 | 0.106 | $3.3 \times 10^{-4}$ |
| Reaction Zone | 108 | 30 | 330 | 1.04 |

| Slurry Flow | $CO_2$ Flow | Loading | Fiber Source |
|---|---|---|---|
| 317 gpm | 168 scfm | 57% | Recycled (Deinked newsprint/ magazines) |

Paper sheets formed from the filled-fiber slurries produced employing the present method exhibited brightness and opacity commensurate with the morphology of the crystals produced by the chosen molar ratios of carbon dioxide to calcium hydroxide. These papers also exhibited good strength and other physical properties. When making paper from the filler-filled fibers produced using the present method, filler retention values of from 70% to 90% were obtained.

In addition to the desirable economics afforded by the present invention, the claimed invention allows the "piecewise" addition of the calcium hydroxide slurry and the carbon dioxide gas, thereby making the process more flexible for operations that call for extended contacting and reaction times and where the pH of the reaction needs to be controlled, such as when processing mechanical pulps. The flowing stream of reactants employed in the present method makes the method amenable to continuous cycling of the flowing stream as desired. Other advantages of the present invention will be recognized by one skilled in the art, given the present disclosure. Whereas specific examples have been presented herein, it is intended that the invention be limited only by the claims appended hereto.

What is claimed:

1. A method for the deposition of particulate filler on papermaking fibers comprising the steps of, in separate vessels, preparing a first slurry of papermaking fibers, preparing a second slurry of calcium hydroxide or the equivalent thereof, and thereafter, combining said first and second slurries with a gaseous precipitant in a flowing stream, under conditions whereby shear is imparted to said gaseous precipitant, to form in situ calcium carbonate on at least the external surfaces of the fibers.

2. The method of claim 1 and including the step of recovering the filled fibers in a form suitable for their use in papermaking.

3. The method of claim 1 and including the step of adjusting the sequence of introduction of reactants to said flowing stream to effectuate control over the pH of the flowing stream.

4. The method of claim 1 and including the step of adjusting the molar ratio of gaseous precipitant to calcium hydroxide to a value of between about 0.1 and about 10.

5. The method of claim 1 wherein said gaseous precipitant is gaseous carbon dioxide.

6. The method of claim 1 wherein said slurry of papermaking fibers has a consistency of not greater than about 5% based on the dry weight of the fibers.

7. A process for the in situ deposition, in a reactor, of particulate filler onto papermaking fibers, the steps of:

in separate vessels, preparing a first slurry containing papermaking fibers, preparing a second slurry containing calcium hydroxide or the equivalent thereof, and thereafter, combining said first and second slurries with a gaseous carbon dioxide precipitant in a flowing stream, under conditions whereby shear is imparted to said gaseous precipitant, to form in situ calcium carbonate on at least the external surfaces of the fibers, wherein the order of introduction of said first and second slurries and said precipitant is selected from one of (a) premixing of said first and second slurries prior to their introduction as a single flowing stream into said flowing stream, (b) introducing said first slurry into said flowing stream at a most upstream location, introducing said precipitant to said flowing stream at a downstream location from the location of the introduction of said first slurry to said flowing stream, and introducing said second slurry to said flowing stream at a downstream location from the location of the introduction of said precipitant to and introducing a further portion of said second slurry to said flowing stream at a downstream location from the location of the introduction of said further portion of said precipitant to said flowing stream, or (d) introducing at least a portion of said second slurry or a portion of said gaseous precipitant to said flowing stream at a first location downstream of the location of the introduction of said first slurry to said flowing stream, introducing at a second location downstream of said first location at least a further portion of that one of said second slurry or said gaseous precipitant which was not introduced to said flowing stream at said first location.

8. The process of claim 7 and including the step of selecting the molar ratio of the gaseous carbon dioxide to the calcium hydroxide to a value of between about 0.1 and about 10.

9. The process of claim 7 wherein all or a portion of the gaseous precipitant is the final reactant introduced downstream to the reactor.

10. The method of claim 7 wherein said slurry of papermaking fibers has a consistency of not greater than about 5% based on the dry weight of the fibers.

* * * * *